US009764572B2

(12) United States Patent
Iwashita et al.

(10) Patent No.: US 9,764,572 B2
(45) Date of Patent: Sep. 19, 2017

(54) PRINTER

(71) Applicant: MAX CO., LTD., Chuo-ku, Tokyo (JP)

(72) Inventors: Takashi Iwashita, Tokyo (JP); Shinichi Takeuchi, Tokyo (JP); Tomoaki Saito, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 15/258,188

(22) Filed: Sep. 7, 2016

(65) Prior Publication Data

US 2017/0066265 A1 Mar. 9, 2017

(30) Foreign Application Priority Data

Sep. 8, 2015 (JP) ..... 2015-177019

(51) Int. Cl.

| | |
|---|---|
| ***B41J 17/28*** | (2006.01) |
| ***B41J 35/08*** | (2006.01) |
| ***B41J 15/16*** | (2006.01) |
| ***B41J 2/325*** | (2006.01) |

(52) U.S. Cl.

CPC ..... *B41J 15/165* (2013.01); *B41J 2/325* (2013.01); *B41J 35/08* (2013.01); *B41J 17/28* (2013.01)

(58) Field of Classification Search

CPC ... B41J 17/00; B41J 17/28; B41J 17/30; B41J 35/04; B41J 35/06; B41J 35/08

See application file for complete search history.

(56) References Cited

U.S. PATENT DOCUMENTS 4,893,134 A * 1/1990 Yamamoto ..... B41J 17/30 347/214

5,769,547 A 6/1998 Igarashi

FOREIGN PATENT DOCUMENTS

| | | | | |
|---|---|---|---|---|
| JP | 60184864 | * | 9/1985 | ..... B41J 17/30 |
| JP | 61-016878 | * | 1/1986 | ..... B41J 17/24 |
| JP | S61-128053 U | | 8/1986 | |
| JP | 61-268468 | * | 11/1986 | ..... B41J 17/30 |
| JP | 02178074 | * | 7/1990 | ..... B41J 17/30 |
| JP | 07-178993 | * | 7/1995 | ..... B41J 17/30 |
| JP | H09-66653 A | | 3/1997 | |

OTHER PUBLICATIONS

Computer generated translation of JP 07-178993, published on Jul. 1995.*

* cited by examiner

*Primary Examiner* — Huan Tran

(74) *Attorney, Agent, or Firm* — Drinker Biddle & Reath LLP

(57) ABSTRACT

A printer includes a conveying roller, a print head, a tension applying section and a guide roller. The conveying roller conveys a print medium. The print head conveys an ink ribbon tape, and performs printing on the print medium. The tension applying section is provided at an upstream side of the print head with respect to a conveyance direction of the ink ribbon tape, and allows tension applied to a center region along a width direction of the ink ribbon tape to be higher than tension applied to both end regions of the ink ribbon tape. The guide roller is provided between the print head and the tension applying section at the upstream side of the print head with respect to the conveyance direction of the ink ribbon tape, and applies tensile force to the ink ribbon tape outward along the width direction.

4 Claims, 16 Drawing Sheets

PRINTER

CROSS-REFERENCE TO RELATED APPLICATION

This application is based on and claims priority under 35 USC 119 from Japanese Patent Application No. P2015-177019 filed on Sep. 8, 2015.

TECHNICAL FIELD

The present invention relates to a printer that conveys an ink ribbon tape and performs printing on a print medium.

BACKGROUND

In a printer of performing printing by applying heat to an ink ribbon tape through a print head, a printing part of the ink ribbon tape, to which the heat has been applied, is extended or retracted, and a difference occurs in tension between the printing part and a non-printing part.

The tension of the ink ribbon tape is partially changed, so that a problem of printing omission and the like may occur when wrinkles are generated in the ink ribbon tape. Therefore, there has been proposed a technology for absorbing partial fluctuation of the tension applied to the ink ribbon tape by dividing stress acting in a width direction of the ink ribbon tape, thereby suppressing the generation of the wrinkles (for example, see JP-A-H09-66653). Furthermore, there has been proposed a technology for forming a spiral convex portion or groove portion in a guide roller that conveys an ink ribbon tape, thereby suppressing the generation of wrinkles (for example, see JP-U-S61-128053).

SUMMARY

In the configuration of absorbing the partial fluctuation of the tension applied to the ink ribbon tape by dividing the stress acting in the width direction of the ink ribbon tape, however, a part with high tension and a part with low tension alternately exist in the width direction of the ink ribbon tape, and thus it is not possible to suppress the generation of wrinkles at the part with low tension.

In the configuration of forming the spiral convex portion or the groove portion in the guide roller, when a heating region of the ink ribbon tape is large in a case and the like of printing a large pattern or a large character, since extension/retraction caused by escape of ink from the ink ribbon tape is large by ink transfer from the ink ribbon tape due to printing, it is not possible to sufficiently suppress the generation of wrinkles.

The present invention has been made to solve the above-described problem, and an object of the present invention is to provide a printer configured to be able to remove wrinkles of an ink ribbon tape.

A printer includes a conveying roller, a print head, a tension applying section and a guide roller. The conveying roller conveys a print medium. The print head conveys an ink ribbon tape along a conveyance direction of the print medium conveyed by the conveying roller, and performs printing on the print medium. The tension applying section is provided at an upstream side of the print head with respect to a conveyance direction of the ink ribbon tape, and allows tension applied to a center region along a width direction of the ink ribbon tape to be higher than tension applied to both end regions of the ink ribbon tape. The guide roller is provided between the print head and the tension applying section at the upstream side of the print head with respect to the conveyance direction of the ink ribbon tape, and applies tensile force to the ink ribbon tape outward along the width direction of the ink ribbon tape.

According to the present invention, when tension is applied to an ink ribbon tape by the conveyance of the ink ribbon tape, tension is increased in a center region along a width direction of the ink ribbon tape, so that it is possible to suppress the generation of wrinkles. In the center region and both end regions along the width direction of the ink ribbon tape, the ink ribbon tape is conveyed while force is being applied to pull the ink ribbon tape outward, so that it is possible to suppress the generation of wrinkles in a region in which tension is small and wrinkles are easily generated.

DETAILED DESCRIPTION

Hereinafter, an embodiment of a printer according to an embodiment of the invention will be described with reference to each of drawings.

<Configuration Example of Printer of Present Embodiment>

Figure 1:
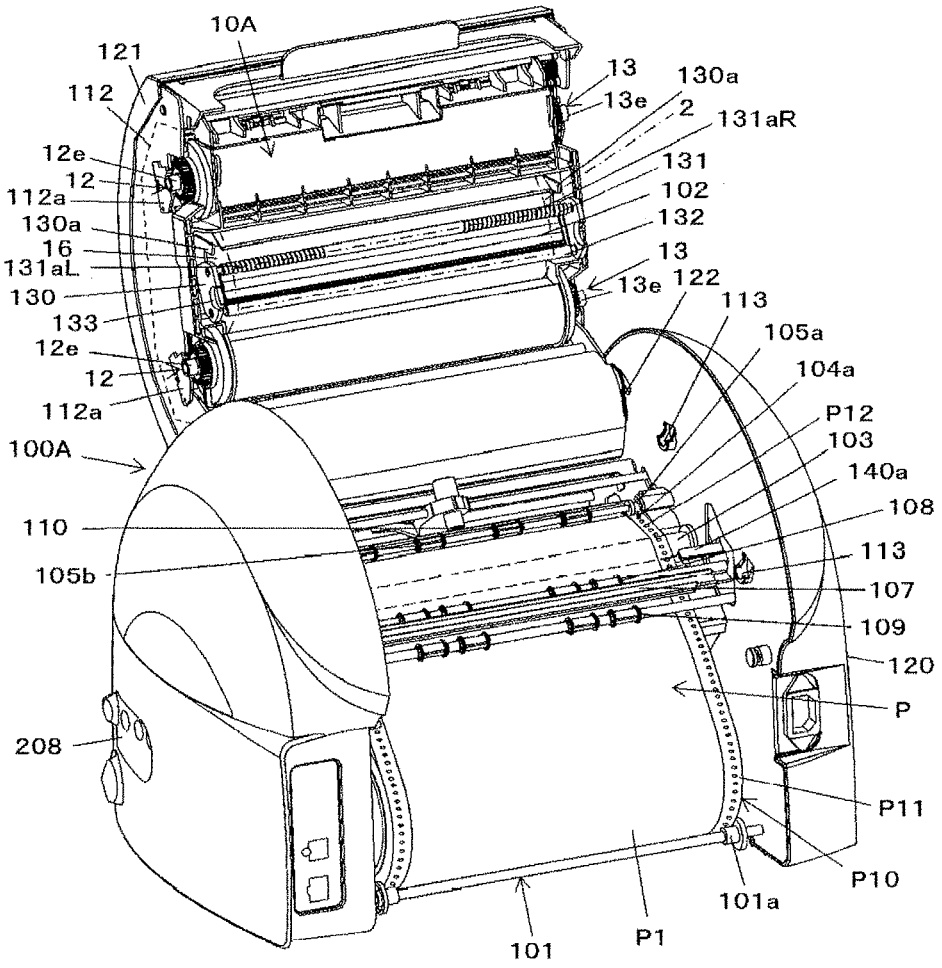
FIG. 1 is a configuration diagram illustrating an example of a printer according to an embodiment of the invention.
Figure 2:
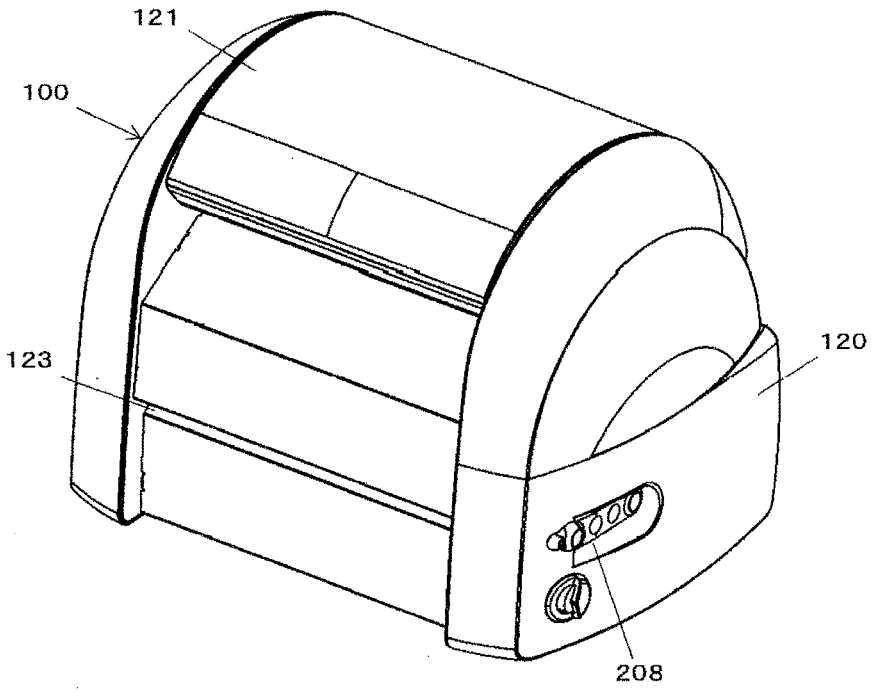
FIG. 2 is a configuration diagram illustrating an example of a printer according to the embodiment of the invention.
Figure 3:
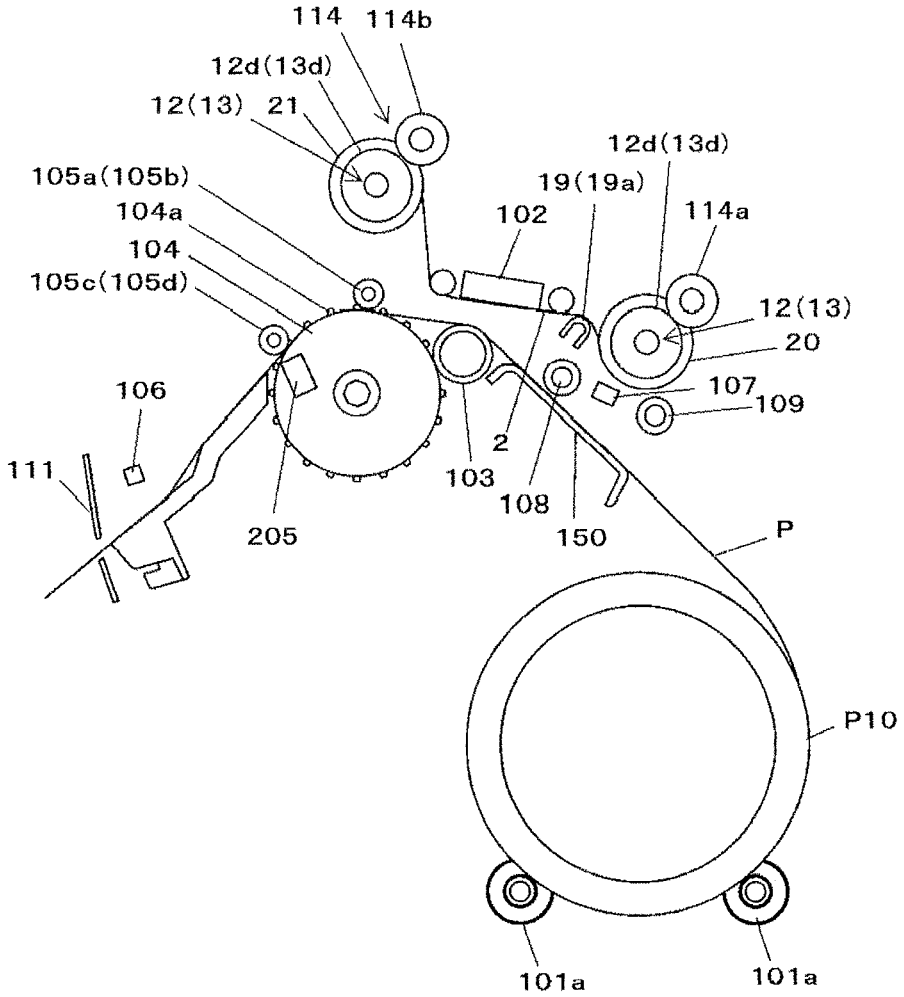
FIG. 3 is a configuration diagram illustrating an example of a printer according to the embodiment of the invention.
Figure 4:
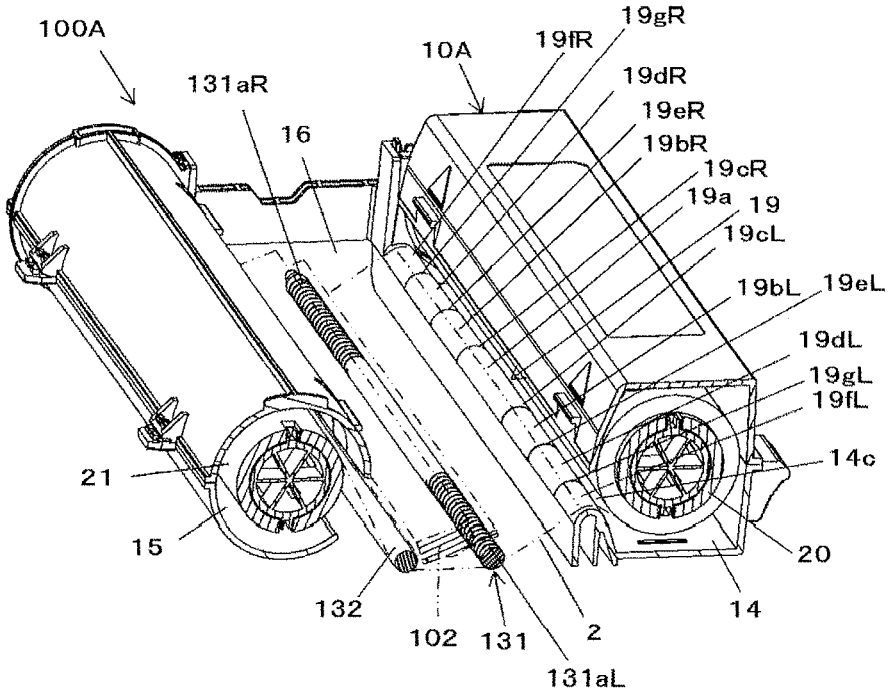
FIG. 4 is a configuration diagram illustrating an example of a printer according to the embodiment of the invention.
Figure 5:
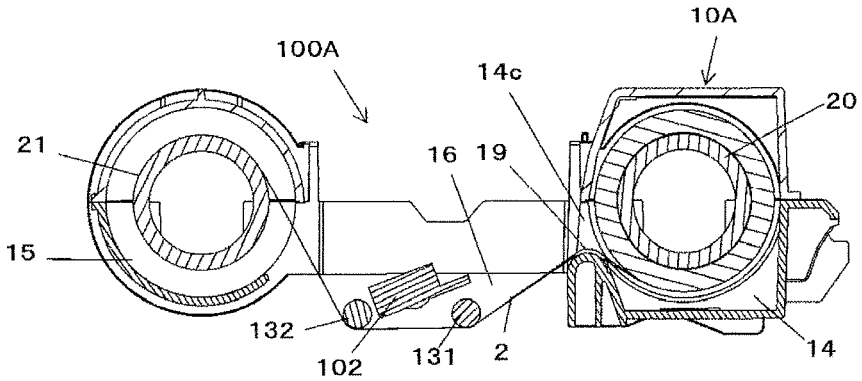
FIG. 5 is a configuration diagram illustrating an example of a printer according to the embodiment of the invention.
Figure 6:
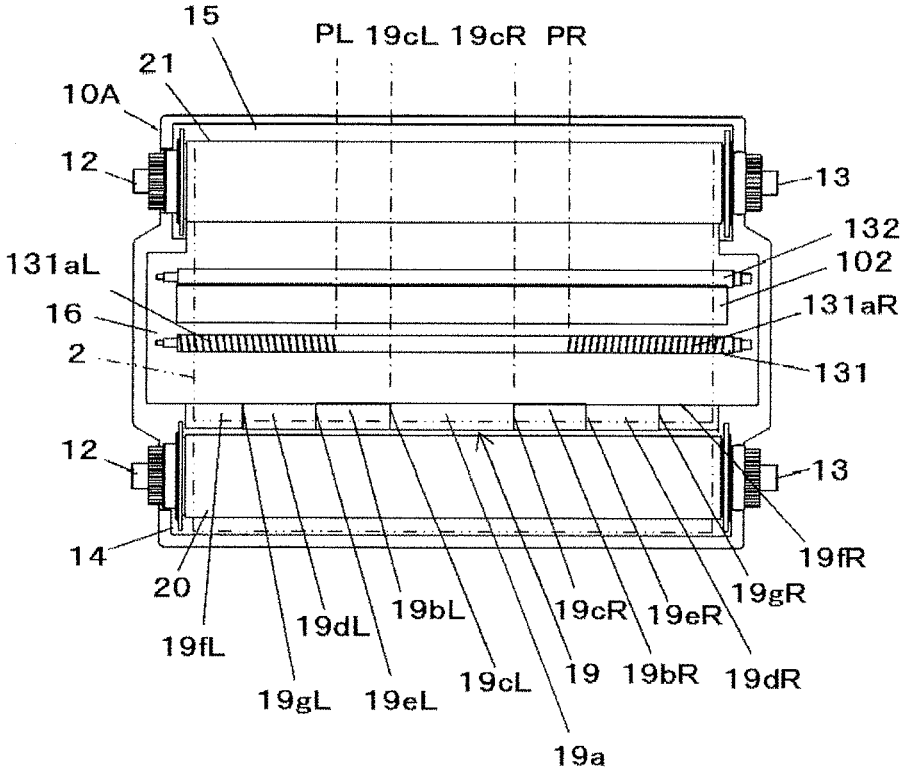
FIG. 6 is a configuration diagram illustrating an example of a printer according to the embodiment of the invention.
Figure 7:
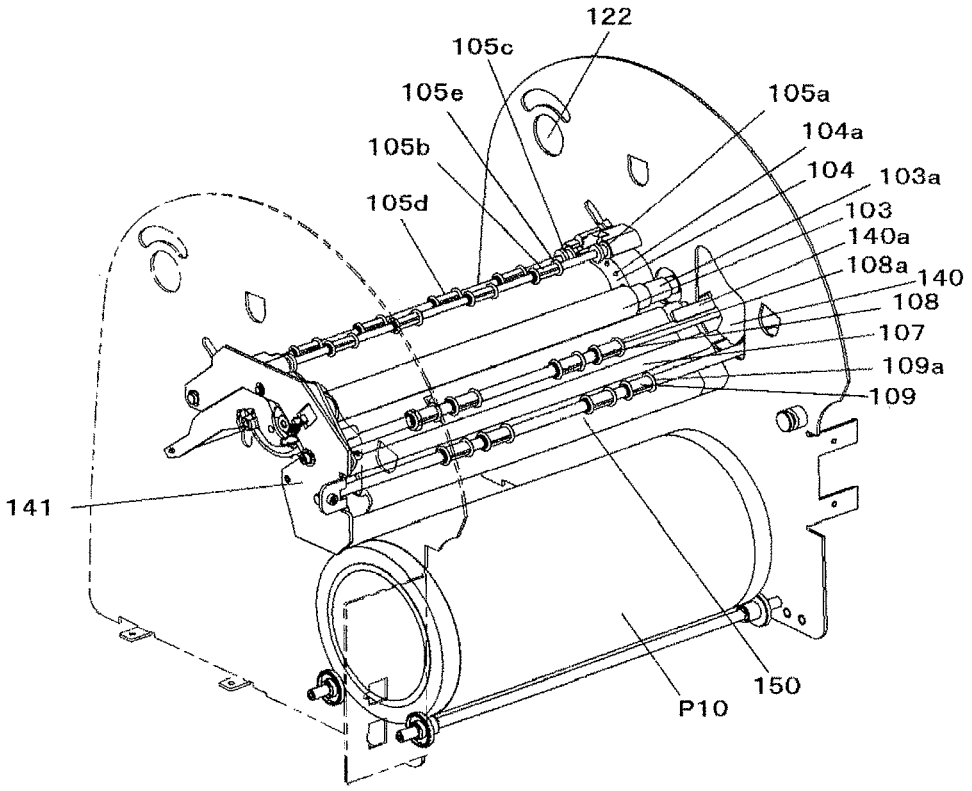
FIG. 7 is a configuration diagram illustrating an example of a printer according to the embodiment of the invention.

FIGS. 1 to 7 are configuration diagrams illustrating an example of a printer of the present embodiment. FIG. 1 is a perspective view when a cover in an open state is viewed from a rear surface in the printer of the present embodiment, and FIG. 2 is a perspective view when the cover in a closed state is viewed from a front surface in the printer of the present embodiment. FIG. 3 is a side view schematically illustrating a conveyance path of a paper and an ink ribbon tape of the printer of the present embodiment, and FIG. 4 is a partially broken perspective view illustrating main parts of a conveyance mechanism of the ink ribbon tape in the printer of the present embodiment. FIG. 5 is a partially broken side view illustrating the main parts of the conveyance mechanism of the ink ribbon tape in the printer of the present embodiment, and FIG. 6 is a plan view illustrating the main elements of the conveyance mechanism of the ink ribbon tape in the printer of the present embodiment. FIG. 7 is a main part exploded perspective view of the printer of the present embodiment.

Figure 8:
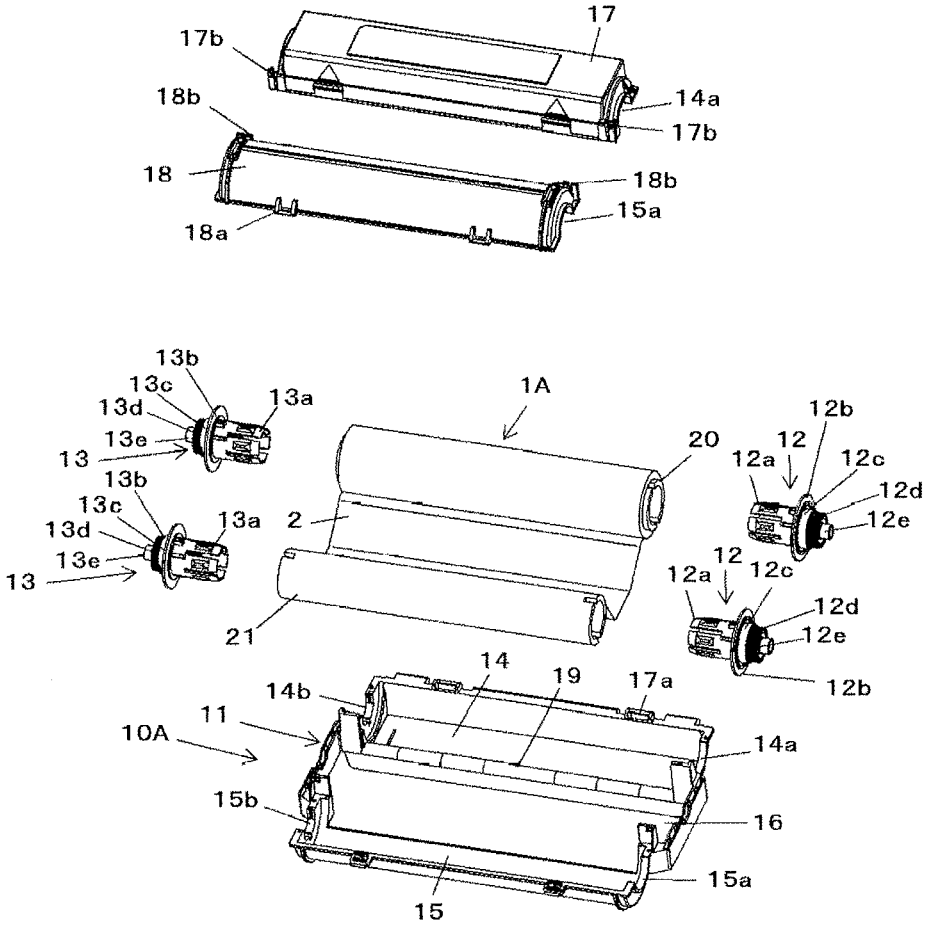
FIG. 8 is a configuration diagram illustrating an example of an ink ribbon cassette according to the embodiment of the invention.
Figure 9:
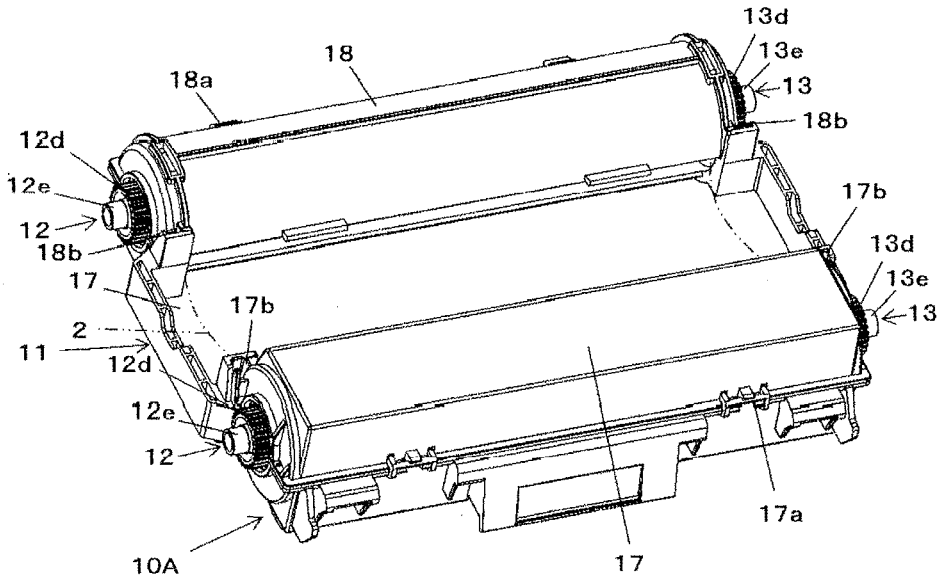
FIG. 9 is a configuration diagram illustrating an example of an ink ribbon cassette according to the embodiment of the invention.

FIGS. 8 and 9 are configuration diagrams illustrating an example of an ink ribbon cassette of the present embodiment, wherein FIG. 8 is an exploded perspective view of the ink ribbon cassette of the present embodiment and FIG. 9 is an external appearance perspective view of the ink ribbon cassette of the present embodiment.

First, a configuration of an ink ribbon cassette 10A will be described. The ink ribbon cassette 10A of the present embodiment includes a body case 11 in which an ink ribbon 1A is detachably stored.

The ink ribbon 1A includes a feeding core 20 around which an ink ribbon tape 2 is wound, and a winding core 21 around which the ink ribbon tape 2 is wound.

In the present example, the ink ribbon tape 2 is configured by coating ink, which can be transferred to a print object by heat and pressure, on a long medium in a thin film state.

The feeding core 20 is an example of a core, and the ink ribbon tape 2 before being used is wound at the time of the start of new use. The feeding core 20 is configured with a cylindrical member such as a paper and resin. The winding core 21 is an example of a core, and the ink ribbon tape 2 after being used is wound. The winding core 21 is configured with a cylindrical member such as a paper and resin.

The ink ribbon cassette 10A includes first connection members 12 respectively mounted in one end portion of the feeding core 20 and one end portion of the winding core 21, and second connection members 13 respectively mounted in the other end portion of the feeding core 20 and the other end portion of the winding core 21.

The body case 11 includes a first storage section 14 in which the feeding core 20 wound with the ink ribbon tape 2 is stored, and a second storage section 15 in which the winding core 21 wound with the ink ribbon tape 2 is stored.

Furthermore, the body case 11 includes a tape conveying part 16 between the first storage section 14 and the second storage section 15, which exposes the ink ribbon tape 2 fed from the feeding core 20 stored in the first storage section 14 and wound around the winding core 21 stored in the second storage section 15.

Moreover, the body case 11 includes a first cover 17 that opens and closes the first storage section 14 and a second cover 18 that opens and closes the second storage section 15.

In the body case 11, a concave part having a shape capable of storing the feeding core 20 wound with the ink ribbon tape 2 is provided at an upstream side with respect to a conveyance direction of the ink ribbon tape 2, so that the first storage section 14 is configured.

In the body case 11, a first receiving part 14*a* is formed at one end portion in the width direction of the first storage section 14 while facing one end portion in the axial direction of the feeding core 20 stored in the first storage section 14, and supports the first connection member 12 mounted in the feeding core 20. Moreover, in the body case 11, a second receiving part 14*b* is formed at the other end portion in the width direction of the first storage section 14 while facing the other end portion in the axial direction of the feeding core 20 stored in the first storage section 14, and supports the second connection member 13 mounted in the feeding core 20.

In the body case 11, a concave part having a shape capable of storing the winding core 21 wound with the ink ribbon tape 2 is provided at a downstream side with respect to the conveyance direction of the ink ribbon tape 2, so that the second storage section 15 is configured.

In the body case 11, a first receiving part 15*a* is formed at one end portion in the width direction of the second storage section 15 while facing one end portion in the axial direction of the winding core 21 stored in the second storage section 15, and supports the first connection member 12 mounted in the winding core 21. Moreover, in the body case 11, a second receiving part 15*b* is formed at the other end portion in the width direction of the second storage section 15 while facing the other end portion in the axial direction of the winding core 21 stored in the second storage section 15, and supports the second connection member 13 mounted in the winding core 21.

The first connection member 12 includes a core mounting part 12*a* inserted into one end portion in the axial direction of the feeding core 20, a flange part 12*b* that restricts a mounting position in the axial direction of the feeding core 20, a shaft support part 12*c* supported to the first receiving part 14*a* of the body case 11, a gear 12*d* to which driving force is transferred, and a shaft part 12*e* supported to a printer 100A. In addition, the first connection member 12 mounted at one end portion in the axial direction of the winding core 21 also has a similar configuration.

The second connection member 13 includes a core mounting part 13*a* inserted into the other end portion in the axial direction of the feeding core 20, a flange part 13*b* that restricts the mounting position in the axial direction of the feeding core 20, a shaft support part 13*c* supported by the second receiving part 14*b* of the body case 11, a gear 13*d* to which driving force is transferred, and a shaft part 13*e* supported by the printer 100A. In addition, the second connection member 13 mounted at the other end portion in the axial direction of the winding core 21 also has a similar configuration.

In the present example, the first cover 17 is mounted in the body case 11 to be able to open and close the first storage section 14 through rotation in which a support point part 17*a* serves as a support point. FIG. 5 illustrates that the first cover 17 has been detached from the body case 11; however, the first cover 17 can be opened and closed even without detaching the support point part 17*a*. In the first cover 17, a lock part 17*b* is locked with the body case 11, so that the first storage section 14 is held in a closed state.

In the present example, the second cover 18 is mounted in the body case 11 to be able to open and close the second storage section 15 through rotation in which a support point part 18*a* serves as a support point. FIG. 5 illustrates that the second cover 18 has been detached from the body case 11; however, the second cover 18 can be opened and closed even without detaching the support point part 18*a*. In the second cover 18, a lock part 18*b* is locked with the body case 11, so that the second storage section 15 is held in a closed state.

In the ink ribbon cassette 10A, the first cover 17 is opened, so that the feeding core 20 and the mounting section 4A of the ink ribbon 1A are detachable from the first storage section 14. In the ink ribbon cassette 10A, the second cover 18 is opened, so that the winding core 21 of the ink ribbon 1A is detachable from the second storage section 15.

In the ink ribbon cassette 10A, the shaft support part 12*c* of the first connection member 12 mounted at one end portion of the feeding core 20 is mounted in the first receiving part 14*a* of the first storage section 14. Moreover, the shaft support part 13*c* of the second connection member 13 mounted at the other end portion of the feeding core 20 is mounted in the second receiving part 14*b* of the first storage section 14. Then, the first cover 17 is closed.

In the ink ribbon cassette 10A, the shaft support part 12*c* of the first connection member 12 mounted at one end portion of the winding core 21 is mounted in the first receiving part 15*a* of the second storage section 15. Furthermore, the shaft support part 13*c* of the second connection member 13 mounted at the other end portion of winding core 21 is mounted in the second receiving part 15*b* of the second storage section 15. Then, the second cover 18 is closed.

In this way, in the ink ribbon cassette 10A, the ink ribbon tape 2 between the feeding core 20 and the winding core 21 is exposed to a tape conveying part 16. Then, the winding core 21 is rotated, so that the ink ribbon tape 2 is fed from the feeding core 20 and is wound around the winding core 21, and thus the ink ribbon tape 2 exposed to the tape conveying part 16 is conveyed.

Figure 10A:
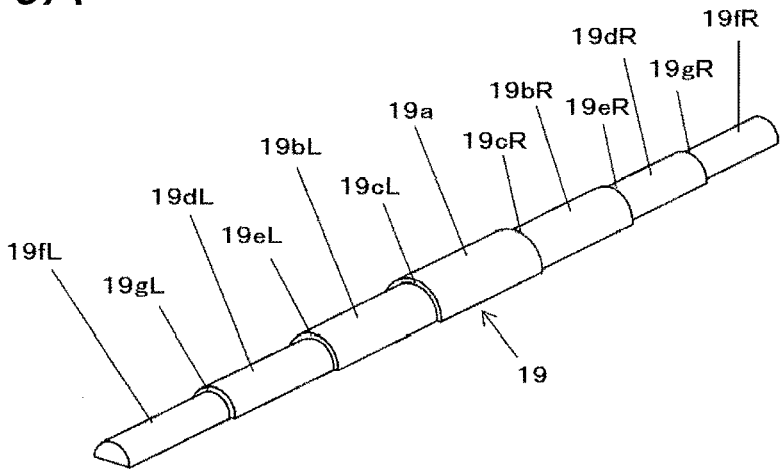
FIGS. 10A and 10B are configuration diagrams illustrating an example of a tension applying section according to the embodiment of the invention.
Figure 10B:
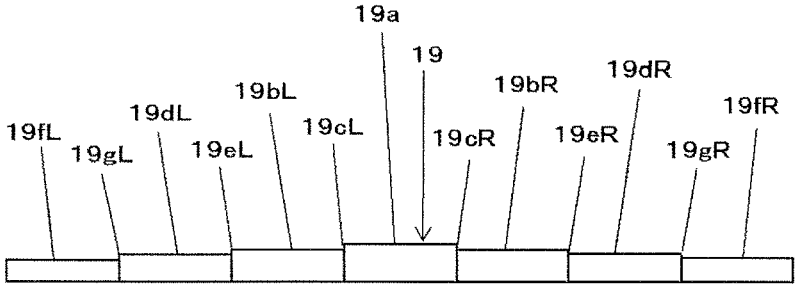

The ink ribbon cassette 10A includes a tension applying section 19 in an outlet 14*c* of the first storage section 14. FIGS. 10A and 10B are configuration diagrams illustrating an example of the tension applying section of the present embodiment. The tension applying section 19 is an example of a tension applying unit, and is configured such that a center part along the width direction of the ink ribbon tape 2 passing through the outlet 14*c* is the highest and a height is reduced step by step from the center part to both side end portions. At the center part, a most protruding part 19*a* is formed to protrude in a direction reverse to the feeding direction of the ink ribbon tape 2 and in a planar direction of the ink ribbon tape.

In the tension applying section 19, second protruding parts 19*b*L and 19*b*R having a protruding height lower than that of the most protruding part 19*a* is formed at an outer side of the most protruding part 19*a*, a stepped part 19*c*L is formed between the most protruding part 19*a* and the one second protruding part 19*b*L, and a stepped part 19*c*R is formed between the most protruding part 19*a* and the other second protruding part 19*b*R along the width direction of the ink ribbon tape 2.

Moreover, in the tension applying section 19, third protruding parts 19*d*L and 19*d*R having a protruding height lower than those of the second protruding parts 19*b*L and 19*b*R at the respective outer sides of the second protruding parts 19*b*L and 19*b*R along the width direction of the ink ribbon tape 2. In the tension applying section 19, a stepped part 19*e*L is formed between the one second protruding part 19*b*L and the one third protruding part 19*d*L, and a stepped part 19*e*R is formed between the other second protruding part 19*b*R and the other third protruding part 19*d*R.

In the tension applying section 19, fourth protruding parts 19*f*L and 19*f*R having a protruding height lower than those of the third protruding parts 19*d*L and 19*d*R are formed at the respective outer sides of the third protruding parts 19*d*L and 19*d*R along the width direction of the ink ribbon tape 2. In the tension applying section 19, a stepped part 19*g*L is formed between the one third protruding part 19*d*L and the one fourth protruding part 19*f*L, and a stepped part 19*g*R is formed between the other third protruding part 19*d*R and the other fourth protruding part 19*f*R.

In this way, the tension applying section 19 is configured in a stepped shape in which the height of the center along the width direction of the ink ribbon tape 2 is high and the heights of both ends are lowered.

In addition, the ink ribbon cassette 10A of the present embodiment may include an RFID tag as identification information recording part. The RFID tag is mounted through adhesion to the body case 11, adhesion to the a tag mounting member stored in the first storage section 14 or the second storage section 15, and the like. The RFID tag is configured such that reading of recorded information by wireless communication and recording of information by wireless communication are possible. In the present example, color information of ink printable on the ink ribbon tape 2, type information regarding the type of ink printable on the ink ribbon tape 2, consumption amount information of the ink ribbon tape 2, manufacturer information and the like are recorded on the RFID tag 3 as identification information.

Next, the configuration of the printer 100A will be described. The printer 100A of the present embodiment includes a mechanism that conveys a paper P in which a long sheet P1 has been adhered to a long release paper P11, performs printing on the sheet P1, and performs cutting (called the whole cutting) over the whole width of a paper P and clipping or cutting of the sheet P1 in a predetermined shape.

The paper P is provided as a rolled paper P10 wound in the form of external winding in which a printing surface of the sheet P1 is directed outward. In the paper P, a plurality of through holes P12 called sprocket holes are formed at both ends in a width direction of the release paper P11 in a longitudinal direction at a constant interval. The sheet P1, the paper P in which the sheet P1 has been adhered to the release paper P11, and the rolled paper P10 wound with the paper P are an example of a print medium.

The printer 100A includes a loading section 101 in which the rolled paper P10 is loaded. The printer 100A includes a print head 102 that performs printing on the paper P drawn out from the rolled paper P10 loaded in the loading section 101, and a platen roller 103 that conveys the paper P to the print head 102 by pressing the paper P.

Moreover, the printer 100A includes sprocket rollers 104 that convey the paper P drawn out from the rolled paper P10 loaded in the loading section 101, pressing rollers 105*a* and 105*c* that press the paper P to the sprocket roller 104, a driven pressing roller 105*b* that presses the paper P inside the pressing roller 105*a* in the width direction of the paper P, and a driven pressing roller 105*d* that presses the paper P inside the pressing roller 105*c* in the width direction of the paper P.

Furthermore, the printer 100A includes a first cleaning member 106 and a second cleaning member 107 that clean the paper P, a first guide roller 108 and a second guide roller 109 that guide the paper P, a first cutting blade part 110 that performs clipping and cutting of the sheet P1, and a second cutting blade part 111 that performs cutting (called the whole cutting) over the whole cutting of the paper P.

Moreover, the printer 100A includes a cassette mounting section 112 in which the ink ribbon cassette 10A illustrated in FIG. 5 and the like is mounted, cassette support parts 113 that support the ink ribbon cassette 10A mounted in the cassette mounting section 112, and an ink ribbon conveying section 114 that conveys the ink ribbon tape 2 of the ink ribbon cassette 10A. In addition, in a configuration in which the RFID tag is provided to the ink ribbon cassette 10A, an antenna is provided to communicate with the RFID tag.

The printer 100A includes the loading section 101, the platen roller 103, the sprocket roller 104, the pressing rollers 105*a* and 105*c*, the driven pressing rollers 105*b* and 105*d*, the first cleaning member 106, the second cleaning member 107, the first guide roller 108, the second guide roller 109, the first cutting blade part 110, the second cutting blade part 111, and the cassette support parts 113 in a printer body 120.

Furthermore, the printer 100A includes the print head 102, the cassette mounting section 112, and the ink ribbon conveying section 114 in a cover 121. The cover 121 is mounted at the printer body 120 to be openable and closable by employing a shaft part 122 as a support point. In the printer 100A, a discharge port 123 of the paper P is provided at a front side of the printer body 120.

As illustrated in FIG. 1, in the printer 100A, when the cover 121 is opened, the ink ribbon cassette 10A mounted in the cassette mounting section 112 withdraws upward, so that the conveyance path of the paper P is exposed. In this way, the rolled paper P10 is loaded in the loading section 101 and the paper P is allowed to pass through the sprocket roller 104 and the pressing rollers 105*a* and 105*c*, thereby enabling the paper P to be conveyed. Furthermore, the exchange of the rolled paper P10 is possible.

Moreover, the ink ribbon cassette 10A is detachable from the cassette mounting section 112 of the cover 121.

As illustrated in FIG. 2, in the printer 100A, when the cover 121 is closed, the ink ribbon cassette 10A mounted in the cassette mounting section 112 is supported to the cassette support parts 113 of the printer body 120. Furthermore, as illustrated in FIG. 3, the print head 102 and the platen roller 103 face to each other while interposing the ink ribbon tape 2 and the paper P therebetween.

The loading section 101 is configured to have a space capable of storing the rolled paper P10 having a predetermined diameter, and is provided with sheet rollers 101*a* that support an outer periphery of the rolled paper P10.

The print head 102 is an example of a print unit and is configured with a thermal head in the present example. In the print head 102, a line-shaped element (not illustrated) is arranged to face the platen roller 103 in a direction along the axial direction of the platen roller 103. As an example, the print head 102 is configured such that its longitudinal length is larger than the width of the sheet P1 in the present embodiment.

The print head 102 is mounted in a support member 130. The support member 130 includes a first guide roller 131 at the feeding side of the ink ribbon tape 2 with respect to the print head 102, and includes a second guide roller 132 at the winding side of the ink ribbon tape 2. Furthermore, the support member 130 includes a bearing part 133 into which a shaft 103*a* of the platen roller 103 enters.

The print head 102, the first guide roller 131, and the second guide roller 132 move in a direction, in which the support member 130 is separated from the platen roller 103, through an operation of a motor to be described later, so that the print head 102, the first guide roller 131, and the second guide roller 132 are positioned at an appropriate position with respect to the platen roller 103.

In relation to the print head 102, the support member 130 is urged in the direction of the platen roller 103 by a spring (not illustrated), so that the paper P is pressed by the platen roller 103.

The first guide roller 131 is an example of a conveying guide unit, and includes feeding grooves 131*a*L and 131*a*R that apply tensile force outward along the width direction of the conveyed ink ribbon tape 2 with respect to the ink ribbon tape 2. The feeding groove 131*a*L is configured by providing a spiral convex and concave shape on a circumferential surface of the first guide roller 131 in a predetermined range of one end side along an axial direction of the first guide roller 131. The feeding groove 131*a*R is configured by providing a spiral convex and concave shape on the circumferential surface of the first guide roller 131 in a predetermined range of the other end side along the axial direction of the first guide roller 131.

In the feeding grooves 131*a*L and 131*a*R, the spiral direction is configured in a direction in which tensile force is generated outward on a contact surface with the ink ribbon tape 2 along the width direction of the ink ribbon tape 2 according to the rotation of the first guide roller 131. In the feeding grooves 131*a*L and 131*a*R, the spiral direction is configured in a reverse direction.

The first guide roller 131 is provided such that a start position PL of a center side in the width direction of the feeding groove 131*a*L is positioned at an outer side from the stepped part 19*c*L between the most protruding part 19*a* and the one second protruding part 19*b*L of the tension applying section 19 and at an inner side from the stepped part 19*e*L between the one second protruding part 19*b*L and the one third protruding part 19*d*L. Furthermore, the first guide roller 131 is provided such that a start position PR of a center side in the width direction of the feeding groove 131*a*R is positioned at an outer side from the stepped part 19*c*R between the most protruding part 19*a* and the one second protruding part 19*b*R of the tension applying section 19 and at an inner side from the stepped part 19*e*R between the other second protruding part 19*b*R and the other third protruding part 19*d*R.

The first guide roller 131 is provided at a downstream side of the tension applying section 19 with respect to the conveyance direction of the ink ribbon tape 2. In this way, when the ink ribbon tape 2 is fed from the feeding core 20, is wound around the winding core 21, and is conveyed, tension around the center is high and tension at both sides is lower than that around the center in the width direction of the ink ribbon tape 2.

That is, tension acts on the ink ribbon tape 2 between the positioning convex part 19 and the first guide roller 131 provided at the downstream side of the positioning convex part 19. However, in the width direction of the ink ribbon tape 2, in relation to tension acting on the ink ribbon tape 2, tension in a contact range with the most protruding part 19*a* is high. Tension in a contact range with the second protruding parts 19*b*L and 19*b*R is lower than that in the contact range with the most protruding part 19*a*, so that the stepped parts 19*c*L and 19*c*R serve as tension change points.

Tension in a contact range with the third protruding parts 19*d*L and 19*d*R is lower than that in the contact range with the second protruding parts 19*b*L and 19*b*R, so that the stepped parts 19*e*L and 19*e*R serve as tension change points.

Tension in a contact range with the third protruding parts 19*f*L and 19*f*R is lower than that in the contact range with the third protruding parts 19*d*L and 19*d*R, so that the stepped parts 19*g*L and 19*g*R serve as tension change points.

By the first guide roller 131 driven according to the conveyance of the ink ribbon tape 2 in which tension has been changed in the width direction, tensile force is applied outward along the width direction of the ink ribbon tape 2.

Thus, in the tension applying section 19, wrinkles of the ink ribbon tape 2, which have been generated at the stepped parts 19*c*L, 19*c*R, 19*e*L, 19*e*R, 19Lg, and 19*g*R serving as the tension change points, are smoothed, so that the wrinkles of the ink ribbon tape 2 are suppressed from being generated.

The platen roller 103 is an example of a conveying unit (a conveying roller), and is configured with one roller that is rotationally driven in a forward and reverse direction by a motor to be described later, in the present example. The platen roller 103 is configured such that its axial length is larger than the width of the paper P, and its circumferential surface is brought into contact with an entire width direction of the paper P, so that the paper P is pressed to the print head 102.

In the printer 100A, when the cover 121 is closed, the shaft of the platen roller 103 enters into the bearing part 133 of the support member 130 mounted with the print head 102, so that the direction of the print head 102 is defined with respect to the platen roller 103.

The sprocket roller 104 is an example of a conveying unit (a conveying roller), and is provided at a downstream side of the platen roller 103 with respect to the conveyance direction of the paper P conveyed in the forward direction from the side of the loading section 101 to the side of the second cutting blade part 111. The sprocket roller 104 is provided at both sides in the width direction of the paper P according to the arrangement of the through holes P12 provided at both ends in the width direction of the paper P, and pins 104*a* entering into the through holes P12 of the release paper P11 constituting a part of the paper P are provided in a circumferential direction according to an interval of the through holes P12.

The sprocket roller 104 is rotationally driven in the forward and reverse direction by a motor to be described later in engagement with the platen roller 103. In the printer 100A, when the sprocket roller 104 and the platen roller 103 are rotationally driven in the forward direction, the paper P is conveyed in the forward direction, and the paper P pressed in the platen roller 103 is printed in the print head 102. Furthermore, the paper P is drawn out from the rolled paper P10. When the sprocket roller 104 and the platen roller 103 are rotationally driven in the reverse direction, the paper P is conveyed in the reverse direction.

The pressing roller 105*a* is provided to face the sprocket roller 104, and is rotationally driven in the forward and reverse direction by a motor to be described later in engagement with the sprocket roller 104 and the platen roller 103.

The driven pressing roller 105*b* is provided between the pair of pressing rollers 105*a* coaxially with the pressing rollers 105*a*, and presses the paper P inside the pressing rollers 105*a* in the width direction of the paper P. The driven pressing roller 105*b* does not receive driving force that rotates the pressing rollers 105*a* and is rotated according to the conveyance of the paper P.

The pressing roller 105*c* is provided to face the sprocket roller 104 at a downstream side of the pressing rollers 105*a* with respect to the conveyance direction of the paper P conveyed in the forward direction. The pressing roller 105*c* is rotationally driven in the forward and reverse direction by a motor to be described later in engagement with the sprocket roller 104 and the platen roller 103.

The driven pressing roller 105*d* is provided between the pair of pressing rollers 105*c* coaxially with the pressing rollers 105*c*, and presses the paper P inside the pressing rollers 105*c* in the width direction of the paper P. The driven pressing roller 105*d* does not receive driving force that rotates the pressing rollers 105*c* and is rotated according to the conveyance of the paper P.

The first cleaning member 106 is configured with a material in which fibers have been entangled, and is provided at a downstream side of the sprocket roller 104 with respect to the conveyance direction of the paper P conveyed in the forward direction. The first cleaning member 106 is configured to be withdrawable from the conveyance path of the paper P.

The second cleaning member 107 is an example of a cleaning unit, is configured with a material in which fibers have been entangled, and is provided at an upstream side of the platen roller 103 with respect to the conveyance direction of the paper P conveyed in the forward direction. The second cleaning member 107 is configured to be withdrawable from the conveyance path of the paper P.

The first guide roller 108 is provided at a downstream side of the second cleaning member 107 and an upstream side of the platen roller 103 with respect to the conveyance direction of the paper P conveyed in the forward direction. The second guide roller 109 is an example of a guide unit, and is provided at an upstream side of the second cleaning member 107 with respect to the conveyance direction of the paper P conveyed in the forward direction. The second guide roller 109 is configured to be withdrawable from the conveyance path of the paper P in engagement with the second cleaning member 107.

As illustrated in FIG. 7, in the present example, a mounting member 140 mounted with the second cleaning member 107 and a mounting member 141 mounted with the first guide roller 108 and the second guide roller 109 are displaced in engagement with an operation of an operation lever 140*a* provided to the mounting member 140, and the second cleaning member 107 and the second guide roller 109 are configured to be displaceable in a direction separated from a conveying guide 150 constituting the conveyance path of the paper P.

The first cutting blade part 110 is provided to face a part between the pair of right and left sprocket rollers 104 between a shaft member provided with the pressing roller 105*a* and the driven pressing roller 105*b* and a shaft member provided with the pressing roller 105*c* and the driven pressing roller 105*d* with respect to the conveyance direction of the paper P conveyed in the forward direction. The first cutting blade part 110 is configured to be driven by a motor to be described later and to be movable in the width direction of the paper P, and an arbitrary shape of clipping and cutting of the sheet P1 adhered to the release paper P11 are performed by the conveyance of the paper P and the movement of the first cutting blade part 110.

The second cutting blade part 111 is provided at a downstream side of the first cleaning member 106 with respect to the conveyance direction of the paper P conveyed in the forward direction, and cuts the paper P, which has been subjected to predetermined processing such as printing, over the entire width thereof.

The cassette mounting section 112 is configured by providing a space, into which the ink ribbon cassette 10A illustrated in FIG. 6 and the like enters, to the cover 121, and includes a supporting mechanism (not illustrated) that supports the ink ribbon cassette 10A to be detachable. In the printer 100A, when the ink ribbon cassette 10A is mounted in the cassette mounting section 112, the ink ribbon tape 2 exposed to the tape conveying part 16 faces the print head 102.

The cassette mounting section 112 includes pressing parts 112*a* that press the shaft parts 12*e* of the first connection member 12 and the shaft parts 13*e* of the second connection member 13 mounted in the feeding core 20 of the ink ribbon cassette 10A illustrated in FIG. 5 and the like, and the shaft parts 12*e* of the first connection member 12 and the shaft parts 13*e* of the second connection member 13 mounted in the winding core 21.

The cassette support units 113 are provided at entrance positions of the shaft parts 12*e* of the first connection member 12 and the shaft parts 13*e* of the second connection member 13, which have been mounted in the feeding core 20 of the ink ribbon cassette 10A illustrated in FIG. 5 and the like, and the shaft parts 12*e* of the first connection member 12 and the shaft parts 13*e* of the second connection member 13, which have been mounted in the winding core 21.

In an operation for closing the cover 121 in which the ink ribbon cassette 10A has been mounted in the cassette mounting section 112, in the state in which the shaft parts 12*e* of the first connection member 12 and the shaft parts 13*e* of the second connection member 13 mounted in the feeding core 20 and the winding core 21 have been pressed by the pressing parts 112*a*, the printer 100A is supported by the corresponding cassette support parts 113.

In this way, the axial direction of the feeding core 20 and the winding core 21 wound with the ink ribbon tape 2 is matched with a direction approximately perpendicular to the conveyance direction of the paper P conveyed by the platen roller 103 and the sprocket rollers 104, so that the paper P and the ink ribbon tape 2 are conveyed approximately in parallel to each other.

The ink ribbon conveying section 114 is an example of a print unit, and includes a gear 114*a*, which is engaged with the gears 12*d* of the first connection member 12 and the gears 13*d* of the second connection member 13 mounted in the feeding core 20 of the ink ribbon cassette 10A illustrated in FIG. 5 and the like, and a braking member (not illustrated) which is connected to the gear 114*a* via a shaft (not illustrated).

Furthermore, the ink ribbon conveying section 114 includes a gear 114*b*, which is engaged with the gears 12*d* of the first connection member 12 and the gears 13*d* of the second connection member 13 mounted in the winding core 21 of the ink ribbon cassette 10A, and a motor (which will be described later) that drives the gear 114*b*.

In the printer 100A, when the ink ribbon cassette 10A is mounted in the cassette mounting section 112 of the cover 121, the gears 12*d* of the first connection member 12 and the gears 13*d* of the second connection member 13 mounted in the feeding core 20 and the winding core 21 are engaged with the corresponding gear 114*a* and gear 114*b*, respectively.

In the operation for closing the cover 121 in which the ink ribbon cassette 10A has been mounted in the cassette mounting section 112, the engagement of the gears 12*d* of the first connection member 12 and the gears 13*d* of the second connection member 13 and the corresponding gear 114*a* and gear 114*b* are held in the state in which the shaft parts 12*e* of the first connection member 12 and the shaft parts 13*e* of the second connection member 13 mounted in the feeding core 20 and the winding core 21 have been respectively supported to the corresponding cassette support parts 113.

Figure 11:
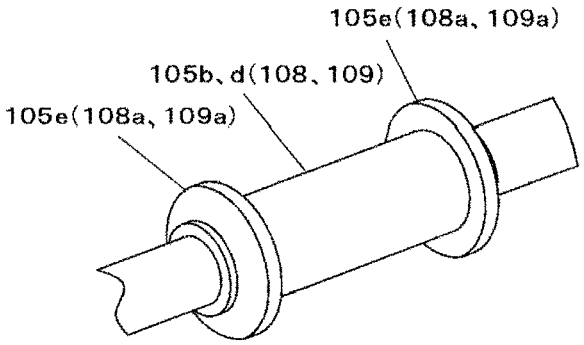
FIG. 11 is a configuration diagram illustrating an example of a driven pressing roller and a guide roller according to the embodiment of the invention.
Figure 12:
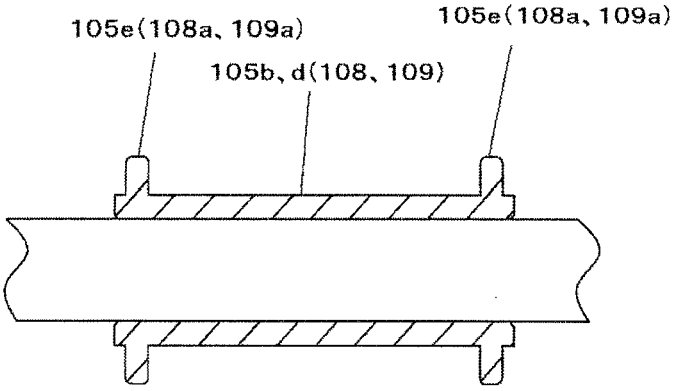
FIG. 12 is a configuration diagram illustrating an example of a driven pressing roller and a guide roller according to the embodiment of the invention.

FIGS. 11 and 12 are configuration diagrams illustrating an example of the driven pressing roller and the guide roller. FIG. 11 is a perspective view of the driven pressing rollers 105*b* and 105*d*, the first guide roller 108, and the second guide roller 109, and FIG. 12 is a sectional view of the driven pressing rollers 105*b* and 105*d*, the first guide roller 108, and the second guide roller 109.

The driven pressing rollers 105*b* and 105*d* are an example of a guide roller and are configured with a plastic. In the present example, at one end side and the other end side in the axial direction of the driven pressing rollers 105*b* and 105*d*, flange parts 105*e* are formed to protrude in the radial direction from the circumferential surface. The flange part 105*e* is an example of a contact part and has a predetermined width along the axial direction of the driven pressing rollers 105*b* and 105*d*, and the two flange parts 105*e* extend with the same radius along the circumferential direction from the center of the driven pressing rollers 105*b* and 105*d*. The flange part 105*e* is configured to have a width of about 1 mm.

The first guide roller 108 is an example of a guide roller and is configured with a plastic. In the present example, at one end side and the other end side in the axial direction of the first guide roller 108, flange parts 108*a* are formed to protrude in the radial direction from the circumferential surface. The flange part 108*a* is an example of a contact part and has a predetermined width along the axial direction of the first guide roller 108, and the two flange parts 108*a* extend with the same radius along the circumferential direction from the center of the first guide roller 108. The flange part 108*a* is configured to have a width of about 1 mm.

The second guide roller 109 is an example of a guide roller and is configured with a plastic. In the present example, at one end side and the other end side in the axial direction of the second guide roller 109, flange parts 109*a* are formed to protrude in the radial direction from the circumferential surface. The flange part 109*a* is an example of a contact part and has a predetermined width along the axial direction of the second guide roller 109, and the two flange parts 109*a* extend with the same radius along the circumferential direction from the center of the second guide roller 109. The flange part 109*a* is configured to have a width of about 1 mm.

<Functional Configuration Example of Printer of Present Embodiment>

Figure 13:
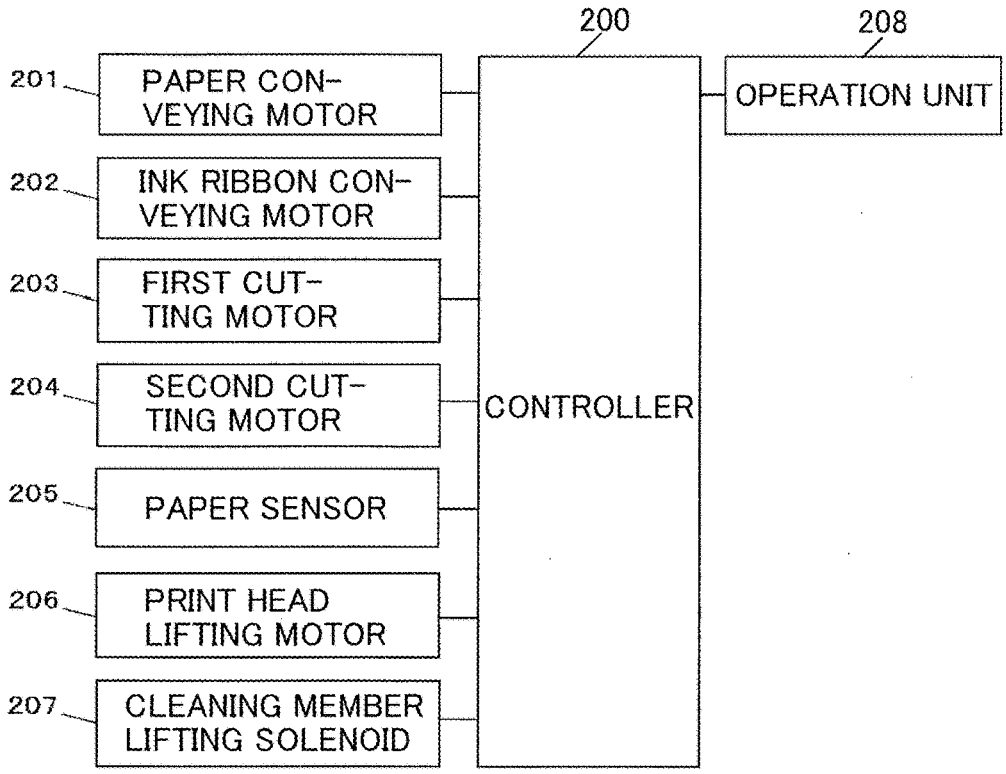
FIG. 13 is a configuration diagram illustrating an example of functions of a printer according to the embodiment of the invention.

FIG. 13 is a block diagram illustrating an example of the functions of the printer of the present embodiment. The printer 100A of the present embodiment includes a controller 200 that controls printing of characters, images and the like based on print data, clipping and cutting of the sheet P1 based on outline data, cutting (called the whole cutting) over the whole width of the paper P based on cutting data, and the like.

Furthermore, the printer 100A includes a paper conveying motor 201 that drives the platen roller 103, the sprocket rollers 104, and the pressing rollers 105*a* and 105*c*, and an ink ribbon conveying motor 202 that drives the winding core 21. Furthermore, the printer 100A includes a first cutting motor 203 that drives the first cutting blade part 110, and a second cutting motor 204 that drives the second cutting blade part 111. Moreover, the printer 100A includes a paper sensor 205 that detects a front end of the paper P.

Furthermore, the printer 100A includes a print head lifting motor 206 that moves the support member 130 mounted with the print head 102 in a direction separated from the platen roller 103, and a cleaning member lifting solenoid 207 that moves the first cleaning member 106 in a direction separated from the conveyance path of the paper P. Moreover, the printer 100A includes an operation unit 208 that receives a conveyance operation and the like of the paper P.

The controller 200 is an example of a control unit, and acquires print data from an external information processing device 300 such as a personal computer, drives the print head 102, the paper conveying motor 201, the ink ribbon conveying motor 202, the print head lifting motor 206, and the cleaning member lifting solenoid 207, and performs printing on the sheet P1. Furthermore, the controller 200 drives the paper conveying motor 201 and the first cutting motor 203, thereby clipping and cutting of the sheet P1 in a predetermined shape. Moreover, the controller 200 drives the paper conveying motor 201 and the second cutting motor 204, thereby cutting of the sheet P1 at a designated position over the whole width.

<Operation Example of Printer of Present Embodiment>

Figure 14:
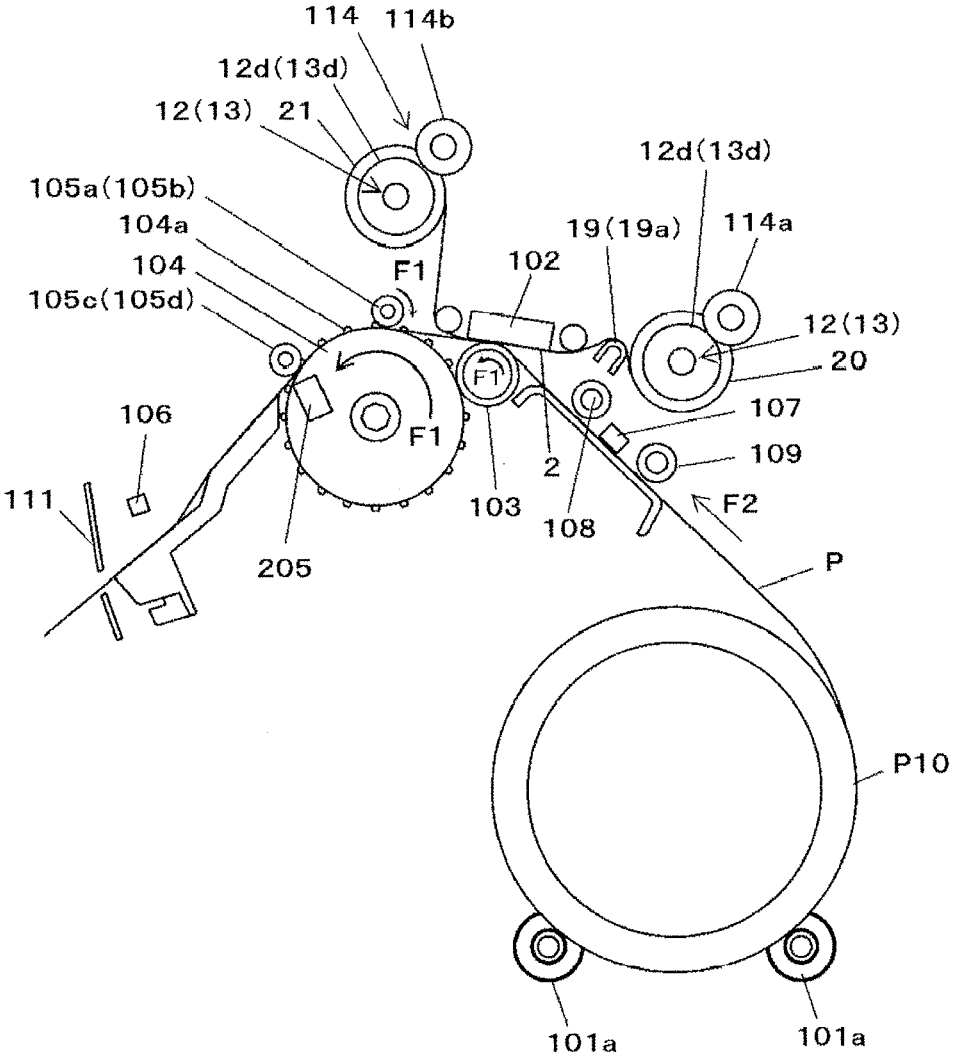
FIG. 14 is a configuration diagram illustrating an operation example of a printer according to the embodiment of the invention.
Figure 15A:
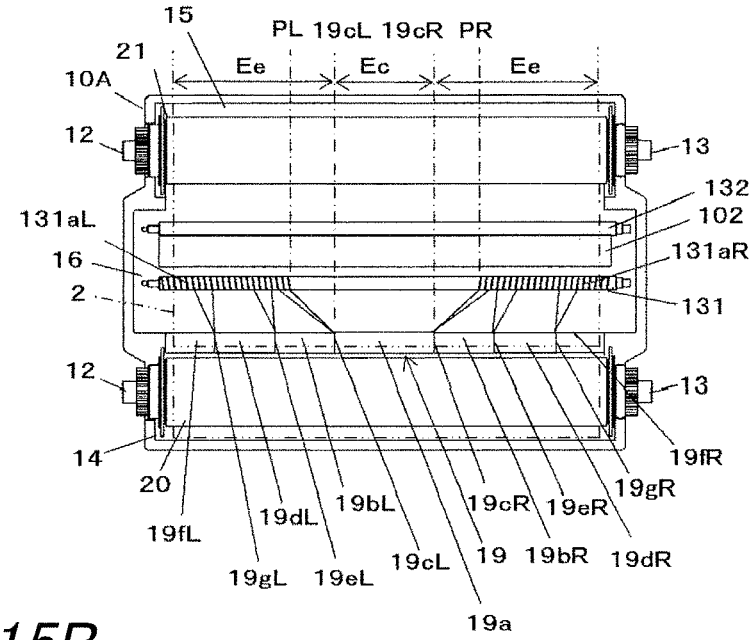
FIGS. 15A and 15B are operation explanation diagrams illustrating a comparative example of a printer according to the embodiment of the invention and a printer according to the related art.
Figure 15B:
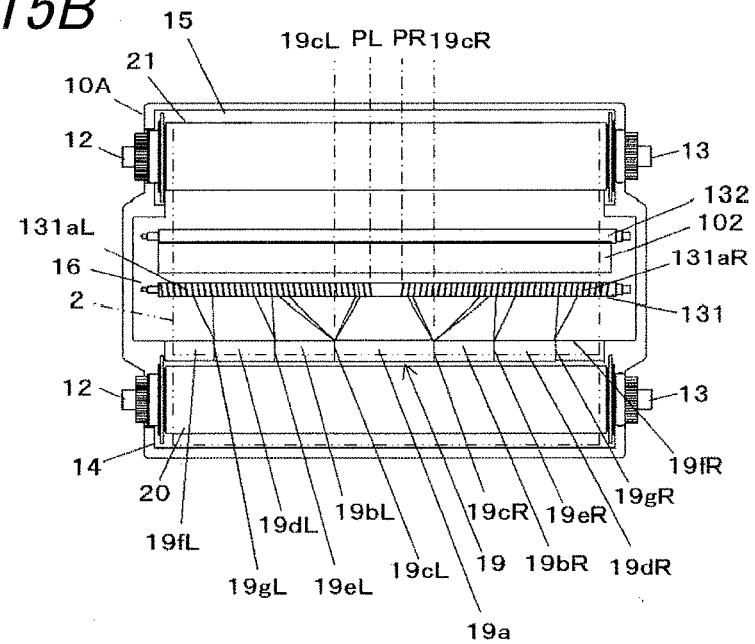

FIG. 14 is an explanation diagram illustrating a print operation of the printer of the present embodiment, and FIGS. 15A and 15B are operation explanation diagrams illustrating a comparative example of the printer of the present embodiment and the related art. Next, with reference to each drawing, an operation example of the printer 100A of the present embodiment will be described.

First, an operation for loading the paper P will be described. In the printer 100A, as illustrated in FIG. 1, when the cover 121 is opened, the ink ribbon cassette 10A mounted in the cassette mounting section 112 withdraws upward, so that the conveyance path of the paper P is exposed.

When the cover 121 is opened, since the print head 102 has already moved to a withdrawn position, the operation lever 140*a* is not pressed by a pressure plate 130*a* integrally provided with the support member 130. Therefore, the second cleaning member 107 enters a state of moving to the withdrawn position not contacting with the paper P. Furthermore, the second guide roller 109 enters a state of being positioned at a second pressing position at which bending of the paper P is suppressed at the time of the reverse conveyance of the paper P. When the second cleaning member 107 moves to the withdrawn position and the second guide roller 109 moves to the second pressing position, the second cleaning member 107 and the second guide roller 109 are separated from the conveying guide 150 constituting the conveyance path of the paper P, so that it is possible to easily allow the paper P to pass through among the conveying guide 150, the second cleaning member 107, and the second guide roller 109. At this time, since the second cleaning member 107 is positioned between the first guide roller 108 and the second guide roller 109, contact of the rolled paper 10, a worker exchanging the rolled paper 10, and the like with the second cleaning member 107 is reduced, so that it is possible to suppress impurities from being attached to the second cleaning member 107.

The rolled paper 10 is loaded in the loading section 101, and then the paper P passes through between the sprocket rollers 104 and the pressing rollers 105*a* and 105*c*, so that the pins 104*a* of the sprocket rollers 104 enter into the through holes P12 formed in the release paper P11. In this way, the cover 121 is closed, so that the rolled paper 10 is loaded in the state in which the conveyance of the paper P by the sprocket rollers 104 is possible.

Next, a print operation of the paper P will be described. In the print operation, the controller 200 drives the cleaning member lifting solenoid 207 to move the first cleaning member 106 from a cleaning position contacting with the paper P to the withdrawn position not contacting with the paper P as illustrated in FIG. 14, thereby separating the first cleaning member 106 from the paper P.

Furthermore, the controller 200 drives the print head lifting motor 206 to move the print head 102 from the withdrawn position not contacting with the platen roller 103 to the print position contacting with the platen roller 103, thereby allowing the ink ribbon tape 2 to be pressed to the paper P between the print head 102 and the platen roller 103.

In the printer 100A, when the print head 102 moves to the print position, the operation lever 140*a* is pressed by the pressure plate 130*a*. In this way, the second cleaning member 107 is moved to the cleaning position contacting with the paper P from the withdrawn position not contacting with the paper P. Furthermore, the second guide roller 109 is moved from the second pressing position at which the bending of the paper P is suppressed at the time of the reverse conveyance of the paper P to a first pressing position at which the paper P is suppressed at the time of the forward conveyance of the paper P. In addition, the second guide roller 109 may be positioned at the second pressing position.

In the state in which the ink ribbon tape 2 has been pressed to the paper P and the second cleaning member 107 has been pressed to the paper P, the controller 200 drives the paper conveying motor 201, thereby rotating the platen roller 103, the sprocket rollers 104, and the pressing rollers 105*a* and 105*c* in the normal rotation direction indicated by an arrow F1. Furthermore, the controller 200 drives the ink ribbon conveying motor 202 to rotate the winding core 21, so that the ink ribbon tape 2 is conveyed according to the conveyance of the paper P. Moreover, the controller 200 drives the print head 102.

In this way, the paper P is conveyed in the forward direction indicated by an arrow F2, and the ink ribbon tape 2 is conveyed according to the conveyance of the paper P, so that characters, images and the like based on print data are printed on the sheet P1 in the ink ribbon tape 2.

In the operation for conveying the paper P in the forward direction indicated by an arrow F2 and performing printing, the paper P is conveyed in the state, in which the second cleaning member 107 has contacted with the sheet P1 serving as a print surface of the sheet P1 at the upstream side of the print head 102, with respect to the conveyance direction of the paper P.

In this way, the print surface of the sheet P1 before being conveyed to the print head 102 is cleaned by the second cleaning member 107, so that it is possible to suppress printing from being performed by the print head 102 in the state in which impurities of dust have been attached to the print surface of the sheet P1.

In the second guide roller 109, since contact parts with the paper P are the flange parts 109*a* and contact areas are small, a contact mark of the second guide roller 109 is suppressed from being left on the print surface of the sheet P1 with which the second guide roller 109 contacts.

Similarly to the second guide roller 109, in the first guide roller 108, since contact parts with the paper P are the flange parts 108*a* and contact areas are small, a contact mark of the first guide roller 108 is suppressed from being left on the print surface of the sheet P1 with which the first guide roller 108 contacts.

Moreover, similarly to the first guide roller 108 and the second guide roller 109, in the driven pressing rollers 105*b* and 105*d*, since contact parts with the paper P are the flange parts 105*e* and contact areas are small, contact marks of the driven pressing rollers 105*b* and 105*d* are suppressed from being left on the print surface of the sheet P1 with which the driven pressing rollers 105*b* and 105*d* contact.

In the above-described operation, since heat is applied to the ink ribbon tape 2 through the print head 102, a printing part having received the heat is extended or retracted and a difference occurs in tension between the print part and a non-printing part.

The tension of the ink ribbon tape 2 is partially changed, a problem such as printing omission may occur when wrinkles are generated in the ink ribbon tape 2. At the downstream side of the print head 102 with respect to the conveyance direction of the ink ribbon tape 2, since ink is transferred to the ink ribbon tape 2 by printing and an ink escape part exists, tension when the ink ribbon tape 2 has been pulled in the conveyance direction is not constant. Therefore, wrinkles of the ink ribbon tape 2 need to be generated at the upstream side of the print head 102.

In this regard, the tension applying section 19, which changes tension in the width direction of the ink ribbon tape 2, is provided at the upstream side of the print head 102 with respect to at the conveyance direction of the ink ribbon tape 2, and the first guide roller 131, which has the spiral feeding grooves 131*a*L and 131*a*R and pulls the ink ribbon tape 2 outward along the width direction, is provided between the print head 102 and the tension applying section 19 at the upstream side of the print head 102 with respect to the conveyance direction of the ink ribbon tape 2, thereby achieving a configuration of removing wrinkles of the ink ribbon tape 2.

First, there is considered a configuration in which as illustrated in FIG. 15B, the start position PL of the feeding groove 131*a*L has been provided at an inner side from the stepped part 19*c*L between the most protruding part 19*a* and the one second protruding part 19*b*L and the start position PR of the feeding groove 131*a*R has been provided at an inner side from the stepped part 19*c*R between the most protruding part 19*a* and the other second protruding part 19*b*R.

In such a configuration, wrinkles generated at the stepped part 19*c*L and the stepped part 19*c*R are pulled outward along the width direction by the feeding grooves 131*a*L and 131*a*R of the first guide roller 131 rotating according to the conveyance of the ink ribbon tape 2, and receive force pulled at the inner side in the width direction.

When wrinkles generated at the stepped parts 19*c*L and 19*c*R are pulled toward the inner side in the width direction and are biased to the center of the ink ribbon tape 2, the wrinkles overlap each other and thus become large.

In contrast, there is considered a configuration in which as illustrated in FIG. 15A, the start position PL of the feeding groove 131*a*L has been provided at an outer side from the stepped part 19*c*L between the most protruding part 19*a* and the one second protruding part 19*b*L and the start position PR of the feeding groove 131*a*R has been provided at an outer side from the stepped part 19*c*R between the most protruding part 19*a* and the other second protruding part 19*b*R.

In such a configuration, tension of the center region Ec in the width direction of the ink ribbon tape 2 is allowed to be larger than that of both end regions Ee by the most protruding part 19*a* of the tension applying section 19, so that the generation of wrinkles is suppressed and wrinkle generation parts are defined by the stepped part 19*c*L and the stepped part 19*c*R.

By the feeding grooves 131*a*L and 131*a*R of the first guide roller 131 rotating according to the conveyance of the ink ribbon tape 2, force for pulling the ink ribbon tape 2 outward along the width direction is directed outward from generation parts of wrinkles generated by the stepped part 19*c*L and the stepped part 19*c*R.

In this way, the wrinkles generated by the stepped part 19*c*L and the stepped part 19*c*R are pulled outward along the width direction of the ink ribbon tape 2 by the feeding grooves 131*a*L and 131*a*R of the first guide roller 131 rotating according to the conveyance of the ink ribbon tape 2.

Accordingly, the wrinkles generated by the stepped part 19*c*L and the stepped part 19*c*R are pulled to the outer side in the width direction, so that it is possible to remove the wrinkles by stretching the wrinkles. Thus, even when extension/retraction caused by ink escape of the ink ribbon tape 2 is large by ink transfer from the ink ribbon tape 2 due to printing such as printing of a large font of characters, it is possible to suppress the generation of wrinkles and to remove generated wrinkles by stretching the wrinkles.

Furthermore, wrinkles, which have been generated at the stepped part 19*e*L and the stepped part 19*e*R, and wrinkles, which have been generated at both end regions Ee, in which tension is smaller than that of the center region Ec in the width direction of the ink ribbon tape 2, by the stepped part 19*g*L and the stepped part 19*g*R, are pulled outward along the width direction by the feeding grooves 131*a*L and 131*a*R of the first guide roller 131.

In this way, wrinkles, which have been generated at a part with small tension, can also be stretched and removed by pulling the ink ribbon tape 2 to the outer side in the width direction.

Furthermore, the tension applying section 19 includes the second protruding parts 19*b*L and 19*b*R, the third protruding parts 19*d*L and 19*d*R, and the fourth protruding parts 19*f*L and 19*f*R, in which heights are lowered step by step, at both sides of the most protruding part 19*a*. In this way, when the ink ribbon tape 2 is conveyed, tension at a side near the center region Ec of the ink ribbon tape 2 in both end regions Ee is high in the width direction of the ink ribbon tape 2, and is reduced outward step by step. Accordingly, by combining a wrinkle generation suppression effect by an increase in tension with a wrinkle stretching effect by pulling outward along the width direction of the ink ribbon tape 2, it is possible to remove wrinkles over the whole width in the width direction of the ink ribbon tape 2.

<Modification Example of Printer of Present Embodiment>

Figure 16:
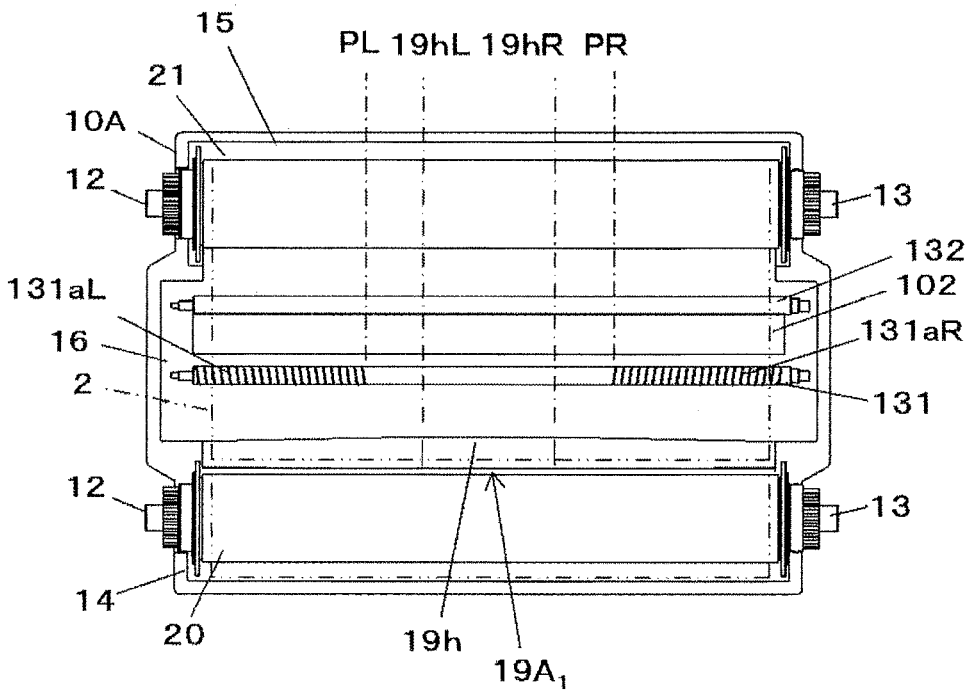
FIG. 16 is a main part configuration diagram illustrating a modification example of a printer according to the embodiment of the invention.
Figure 17:
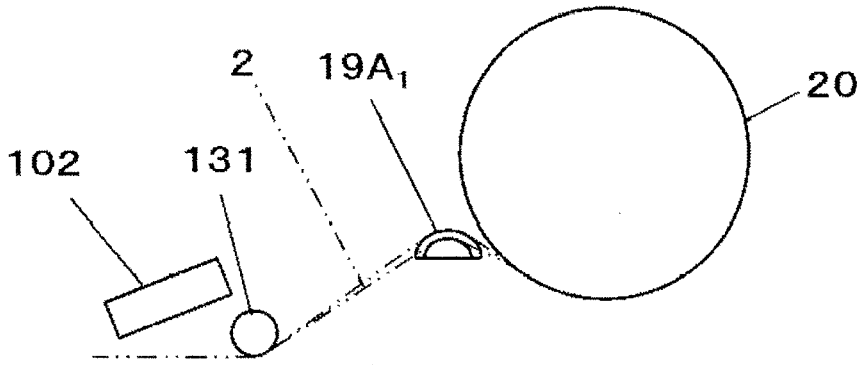
FIG. 17 is a main part configuration diagram illustrating a modification example of a printer according to the embodiment of the invention.
Figure 18:
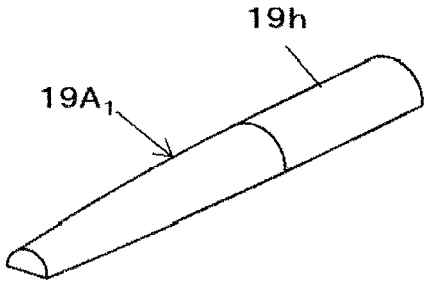
FIG. 18 is a configuration diagram illustrating a modification example of a tension applying section according to the embodiment of the invention.

FIGS. 16 and 17 are main part configuration diagrams illustrating modification examples of the printer of the present embodiment, and FIG. 18 is a configuration diagram illustrating a modification example of the tension applying section of the present embodiment. In a tension applying section 19$A_1$, a most protruding part 19*h* is formed at the center along the width direction of the ink ribbon tape 2 to protrude in a reverse direction with respect to the feeding direction of the ink ribbon tape 2 and in the planar direction of the ink ribbon tape 2.

The tension applying section 19$A_1$ is configured in a curved shape in which a protruding height of the center region along the width direction of the ink ribbon tape 2 is high and a height is gradually lowered toward both ends from the most protruding part 19*h*.

In the first guide roller 131, the start position PL of the feeding groove 131*a*L is provided at an outer side from one end portion 19*h*L of the most protruding part 19*h*. In the first guide roller 131, the start position PR of the feeding groove 131*a*R is provided at an outer side from the other end portion 19*h*R of the most protruding part 19*h*.

In such a configuration, by the most protruding part 19*h* of the tension applying section $19A_1$, tension around the center in the width direction of the ink ribbon tape 2 is increased, so that the generation of wrinkles is suppressed and a wrinkle generation part is defined by the most protruding part 19*h*.

By the feeding grooves 131*a*L and 131*a*R of the first guide roller 131 rotating according to the conveyance of the ink ribbon tape 2, tensile force outward along the width direction of the ink ribbon tape 2 is directed outward from generation parts of wrinkles generated by the end portion of the most protruding part 19*h*.

In this way, the wrinkles generated by the most protruding part 19*h* are pulled outward along the width direction by the feeding grooves 131*a*L and 131*a*R of the first guide roller 131 rotating according to the conveyance of the ink ribbon tape 2.

Accordingly, the wrinkles generated in the most protruding part 19*h* are pulled to the outer side in the width direction, so that it is possible to remove wrinkles by stretching the wrinkles.

Furthermore, wrinkles, which have been generated at a part in which tension is smaller than that around the center in the width direction of the ink ribbon tape 2, are pulled outward along the width direction by the feeding grooves 131*a*L and 131*a*R of the first guide roller 131.

In this way, wrinkles, which have been generated at a part with small tension, can also be stretched and removed by pulling the ink ribbon tape 2 to the outer side in the width direction.

Figure 19:
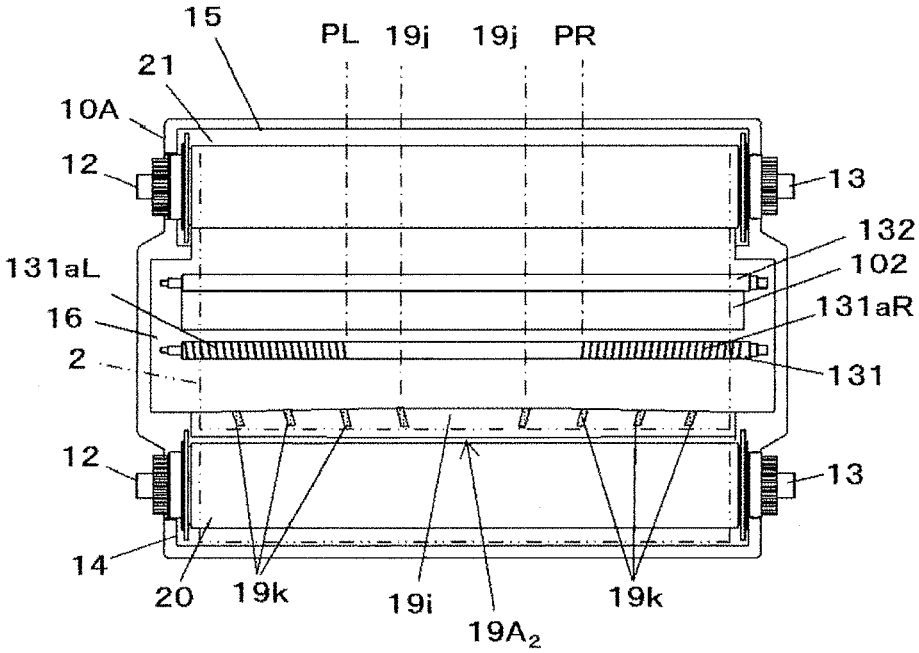
FIG. 19 is a main part configuration diagram illustrating another modification example of a printer according to the embodiment of the invention.
Figure 20:
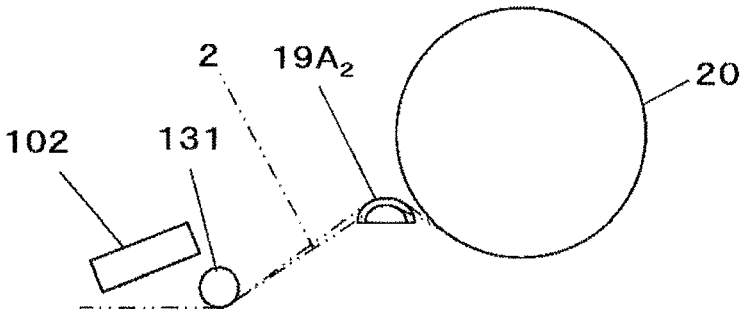
FIG. 20 is a main part configuration diagram illustrating another modification example of a printer according to the embodiment of the invention.
Figure 21A:
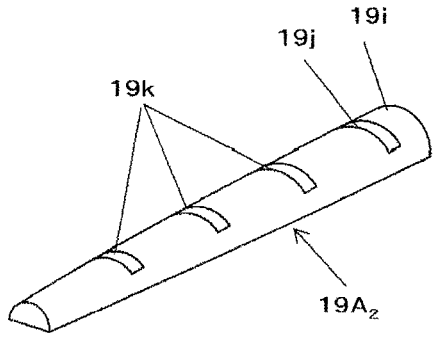
FIGS. 21A and 21B are configuration diagrams illustrating another modification example of a tension applying tension applying section according to the embodiment of the invention.
Figure 21B:
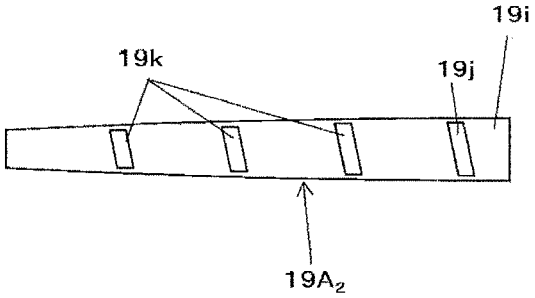

FIGS. 19 and 20 are main part configuration diagrams illustrating other modification examples of the printer of the present embodiment, and FIGS. 21A and 21B are configuration diagrams illustrating another modification example of the tension applying section of the present embodiment. In a tension applying section $19A_2$, a most protruding part 19*i* is formed at the center along the width direction of the ink ribbon tape 2 to protrude in a reverse direction with respect to the feeding direction of the ink ribbon tape 2 and in the planar direction of the ink ribbon tape 2.

The tension applying section $19A_2$ is configured in a curved shape in which a protruding height of the center region along the width direction of the ink ribbon tape 2 is high and a height is gradually lowered toward both ends from the most protruding part 19*i*. The tension applying section $19A_2$ includes frictional members 19*j* at one end portion and the other end portion of the most protruding part 19*i*, and frictional members 19*k* at an outer side of the most protruding part 19*i*. The frictional members 19*j* and 19*k*, for example, are configured by exposing a member such as rubber, which has a frictional coefficient higher than that of resin constituting the tension applying section $19A_2$, to the tension applying section $19A_2$ at a predetermined interval.

In the first guide roller 131, the start position PL of the feeding groove 131*a*L is provided at an outer side from the frictional member 19*j* at one end portion of the most protruding part 19*i*. In the first guide roller 131, the start position PR of the feeding groove 131*a*R is provided at an outer side from the frictional member 19*j* at the other end portion of the most protruding part 19*i*.

In such a configuration, by the most protruding part 19*i* of the tension applying section $19A_2$, tension around the center in the width direction of the ink ribbon tape 2 is increased, so that the generation of wrinkles is suppressed and wrinkle generation parts are defined by the frictional members 19*j* and 19*k*.

By the feeding grooves 131*a*L and 131*a*R of the first guide roller 131 rotating according to the conveyance of the ink ribbon tape 2, tensile force outward along the width direction of the ink ribbon tape 2 is directed outward from generation parts of wrinkles generated by the end portions of the frictional members 19*j* and 19*k*.

In this way, the wrinkles generated by the frictional members 19*j* and 19*k* are pulled outward along the width direction by the feeding grooves 131*a*L and 131*a*R of the first guide roller 131 rotating according to the conveyance of the ink ribbon tape 2.

Accordingly, the wrinkles generated in the frictional members 19*j* and 19*k* are pulled to the outer side in the width direction, so that it is possible to remove wrinkles by stretching the wrinkles.

Furthermore, wrinkles, which have been generated by the frictional members 19*j* in which tension is smaller than that around the center in the width direction of the ink ribbon tape 2, are pulled outward along the width direction by the feeding grooves 131*a*L and 131*a*R of the first guide roller 131.

In this way, wrinkles, which have been generated at a part with small tension, can also be stretched and removed by pulling the ink ribbon tape 2 to the outer side in the width direction.

In the above-described each embodiment, the tension applying section is provided in the ink ribbon cassette 10A; however, the tension applying section may be provided in, for example, the cover 121 of the ink ribbon cassette 10A.

The present invention is applied to a printer using an ink ribbon tape which is transferred with heat and pressure.

What is claimed is:

1. A printer comprising:

a conveying roller that conveys a print medium;

a print head that conveys an ink ribbon tape along a conveyance direction of the print medium conveyed by the conveying roller, and that performs printing on the print medium;

a tension applying section that is provided at an upstream side of the print head with respect to a conveyance direction of the ink ribbon tape, and that allows tension applied to a center region along a width direction of the ink ribbon tape to be higher than tension applied to both end regions of the ink ribbon tape; and a guide roller that is provided between the print head and the tension applying section at the upstream side of the print head with respect to the conveyance direction of the ink ribbon tape, and that applies tensile force to the ink ribbon tape outward along the width direction of the ink ribbon tape, wherein the tension applying section includes a most protruding part at a position facing the center region along the width direction of the ink ribbon tape, the guide roller includes:

a roller member which rotates according to conveyance of the ink ribbon tape; and at least one spiral feeding groove which is formed on a circumferential surface of the roller member and which is formed along an axial direction of the roller member, the at least one feeding groove is formed at an outer side of a position facing the most protruding part, and the at least one feeding groove is not formed at a portion where the most protruding part faces the roller member.

2. The printer according to claim 1, wherein the guide roller includes two spiral feeding grooves, one feeding groove is formed at one end portion side of the roller member in the axial direction of the roller member, and the other feeding groove is formed at the other end portion side of the roller member in the axial direction of the roller member.

3. The printer according to claim 2, wherein a start position of the one feeding groove is provided at an outer side from one stepped part of the most protruding part, and another start position of the other feeding groove is provided at the other outer side from the other stepped part of the most protruding part.

4. The printer according to claim 1, wherein the tension applying section is configured in a stepped shape in which a height of a position facing the center region along the width direction of the ink ribbon tape is high and heights of both end sides are low.

* * * * *